United States Patent [19]

Raabe et al.

[11] 3,948,595

[45] Apr. 6, 1976

[54] APPARATUS FOR THE HIGH TEMPERATURE ANNEALING OF METALLIC COILS

[75] Inventors: Francis O. Raabe, Butler Township, Butler County; Frank A. Yossa, Butler, both of Pa.

[73] Assignee: Armco Steel Corporation, Middletown, Ohio

[22] Filed: June 4, 1974

[21] Appl. No.: 476,334

Related U.S. Application Data

[62] Division of Ser. No. 349,559, April 9, 1973, Pat. No. 3,846,190.

[52] U.S. Cl. ..... 432/260; 148/155; 148/157; 248/121; 248/127

[51] Int. Cl.[2] ..... C21D 9/00

[58] Field of Search ..... 148/155, 157, 13, 13.1, 148/113; 248/121, 126, 127; 266/5 R, 4 B; 432/253, 260

[56] References Cited

UNITED STATES PATENTS

| | | | |
|---|---|---|---|
| 2,067,549 | 1/1937 | Sykes | 148/155 |
| 2,538,244 | 1/1951 | Hileman | 148/13 |
| 3,067,073 | 12/1962 | Neuhauser et al. | 148/13 R |
| 3,846,190 | 11/1974 | Raabe et al. | 148/121 |

*Primary Examiner*—Walter R. Satterfield

*Attorney, Agent, or Firm*—Melville, Strasser, Foster & Hoffman

[57] ABSTRACT

A method and means for the high temperature annealing of metallic coils whereby a coil to be annealed is held, with its axis in a horizontal position, in the annealing furnace by support means passing through the eye of the coil. The support means comprises a horizontal member passing through the eye of the coil and means to support the horizontal member in such a way that the coil contacts only the horizontal member.

4 Claims, 6 Drawing Figures

APPARATUS FOR THE HIGH TEMPERATURE ANNEALING OF METALLIC COILS

REFERENCE TO RELATED APPLICATION

This is a division of the copending application Ser. No. 349,559, filed Apr. 9, 1973, in the name of the same inventors and entitled METHOD AND APPARATUS FOR THE HIGH TEMPERATURE ANNEALING OF METALLIC COILS, issued Nov. 5, 1974 as U.S. Pat. No. 3,846,190.

BACKGROUND OF THE INVENTION

1. Field of the Invention

The invention relates to a method and apparatus for the high temperature annealing of metallic coils and more particularly to a method and apparatus whereby the coil is supported in a horizontal position in the annealing furnace by support means, a portion of which passes through the eye of the coil, said portion being the only part of the support means contacting the coil.

2. Description of the Prior Art

It will be understood by one skilled in the art that the method and apparatus of the present invention may be employed during a high temperature anneal for any purpose and applied to any metallic coiled material. As used herein, the terms "metallic coil" and "metallic coiled material" refer to metallic strip stock wound about a mandrel or the like of a conventional coiling machine, all as is well known in the art. When each coil is removed from the coiling machine mandrel, it comprises a hollow cylindrical element having a plurality of convolutions. For purposes of clarity and convenience, the central, axial hollow of the coil, defined by the convolutions and formed and filled by the coiling machine mandrel during the coiling operation will hereinafter be referred to as the "eye" of the coil.

As used herein, the term "high temperature anneal" refers to an anneal conducted at such a temperature that a coil resting on its end or its side within an annealing furnace would tend to buckle or sag and when standing on end (and in the absence of an adequate annealing separator between the convolution edges at the end upon which it rests) would have its convolution edges upon which it rests stick or weld together. As a consequence, the present invention is directed to anneals of the type generally conducted above about 1100°F. The final high temperature anneals employed in the production of silicon irons having preferred orientations for electrical uses, for example, are frequently conducted at temperatures within the range of from about 1900°F to about 2300°F. The final high temperature anneal employed in the production of cubic texture silicon-iron is an excellent example of an anneal wherein the teachings of the present invention may be advantageously employed. Therefore, the invention will, for purposes of an exemplary showing, be described in terms of its application in such an anneal, although it is to be understood that the invention is not intended to be so limited.

Cubic textured silicon-iron, frequently referred to as cube-on-face oriented silicon-iron, is characterized by high straight-grain and high cross-grain permeabilities and has preponderantly a (100)[001] crystal orientation by Miller's indices. Such material is well known in the art and methods for its manufacture are taught in U.S. Pat. Nos. 3,130,092; 3,130,093; 3,130,094 and 3,130,095. In all of these methods, the cubic texture or cube-on-face orientation is achieved during the secondary grain growth stage of the final anneal by virtue of the surface energy phenomenon. The final anneal is conducted at a temperature of from about 1900°F to about 2300°F (and preferably about 2200°F). The annealing atmosphere during the final high temperature anneal may be an inert gas such as argon or helium. Dry hydrogen is a preferred annealing atmosphere. A minute amount of a highly polar compound may or may not be added to the annealing atmosphere or the annealing separator. A non-glass forming annealing separator is used. A preferred annealing separator comprises alumina powder dusted upon the coil convolutions.

In accordance with prior art practice, the final high temperature anneal was generally performed in an annealing furnace in which each of the coils rested upon one of its ends with its axis vertically oriented. Such procedure, however, led to a number of problems. First of all, in this configuration, the coil at high annealing temperatures had no strength and tended to buckle. Of an even more serious nature, however, was the fact that during the dusting of the alumina annealing separator on the coil convolutions, the convolution edges are not coated. As a result of this, the coil convolution edges upon which the coil rested would tend to stick or weld together as a result of the pressure from the weight of the coil and the high temperature. This sticking or welding of the coil convolution edges has constituted a serious problem believed to be largely unavoidable by prior art workers, although much time and effort has been expended on development of improved annealing separators.

U.S. Pat. No. 3,084,081 teaches the laying of coils on their sides for various puposes during at least the initial stages of a final anneal. This patent, however, is not directed to silicon-irons having a cube-on-face orientation and clearly teaches that if the anneal requires temperatures above 1100°F, the coils must be set up on their ends, as is conventional.

The present invention provides a method and apparatus whereby a metallic coil, provided with any appropriate separator including alumina powder applied by dusting, may be subjected to a high temperature anneal for the required period of time without sagging, buckling or sticking or welding of the convolution edges.

SUMMARY OF THE INVENTION

According to the teachings of the present invention, a metallic coil to be subjected to a high temperature anneal may be provided with any appropriate annealing separator. The annealing separator may be of any suitable type including a chemical composition in slurry or powdered form, a mechanical separator or the like. According to the nature of the annealing separator used, it may be applied in any of the well known and conventional ways as by spraying, doctoring, dusting or the like.

The coil is thereafter supported in the annealing furnace with the coil axis in a horizontal orientation by a support means passing through the eye of the coil. The support means, in turn, comprises a horizontal member, itself supported in such a way that the metallic coil contacts only the horizontal member.

In one embodiment of the invention, the horizontal support member comprises a cylindrical element located within the eye of the coil and having end portions extending beyond the ends of the coil. The horizontal member may, for example, constitute the mandrel on which the metallic strip was coiled The horizontal member, in turn, is supported at its ends by a pair of spaced uprights mounted on a base member.

When desired, a second coil may be similarly mounted on a substantially identical support means above the first coil. In such an instance, the base member of the support means of the second coil has a pair of downwardly depending legs affixed thereto. The legs are oriented in parallel spaced relationship and so sized as to straddle the first coil and rest upon the base member of the support means for the first coil.

DESCRIPTION OF THE PREFERRED EMBODIMENTS

Figure 1:
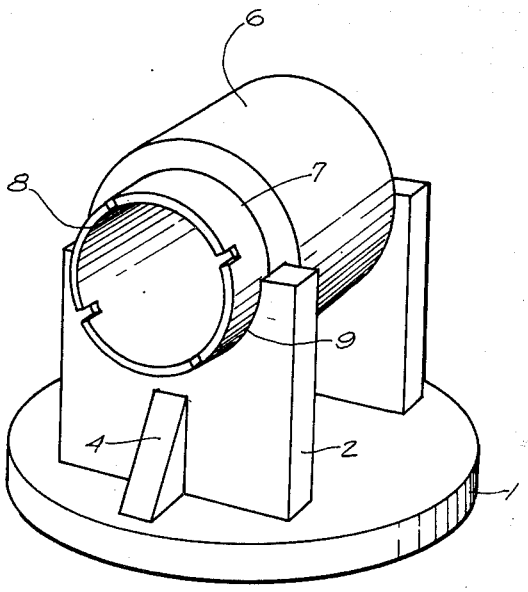
FIG. 1 is a perspective view illustrating a support means of the present invention with a coil mounted thereon.
Figure 2:
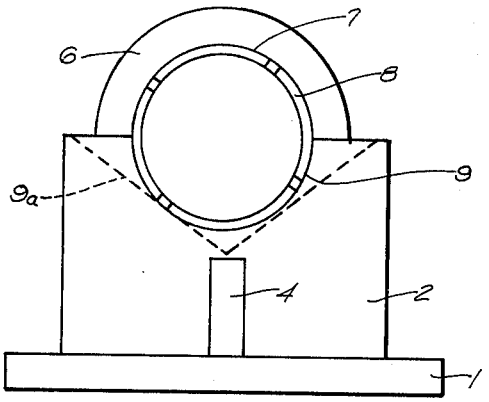
FIG. 2 is an end elevational view of the coil and support means of FIG. 1.
Figure 3:
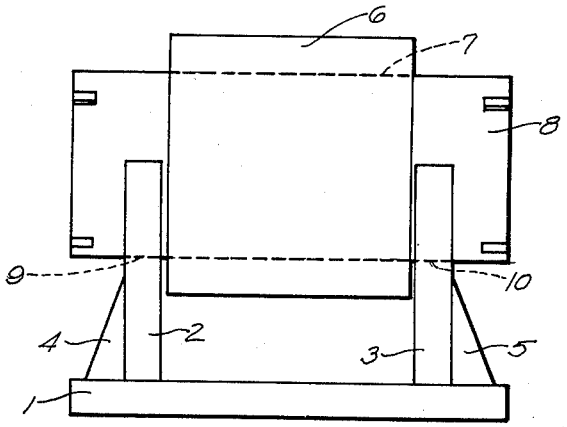
FIG. 3 is a side elevational view of the coil and support means of FIG. 1.

As indicated above, the process of the present invention contemplates the maintaining of a metallic coil in a horizontal position during a high temperature anneal, the coil being contacted only by a support means passing through its eye. An exemplary embodiment of the support structure of the present invention is illustrated in FIGS. 1, 2 and 3, wherein like parts have been given like index numerals. In the embodiment illustrated, the support means comprises a base 1. The nature of the base does not constitute a limitation on the present invention and will be, in part at least, dictated by the type of annealing furnace contemplated. In the embodiment shown the base is illustrated as a large, thick metallic disc adapted to rest upon refractory supports (not shown) in the furnace. Permanently affixed to the base 1, as by welding or the like, there is a pair of vertically oriented metallic supports 2 and 3. For additional strength and stability, the vertical supports may be provided with metallic brace means 4 and 5 affixed to their respective vertical supports and the base member 1.

As is most clearly shown in FIG. 3, the vertical supports 2 and 3 are parallel and are spaced from each other by a distance greater than the length of the coil 6. The coil 6 has a central, axial eye 7 through which a horizontal support member 8 extends.

For purposes of an exemplary showing, the horizontal support 8 is illustrated as being the mandrel upon which the coil was formed in a conventional coiling machine. However, it will be understood by one skilled in the art that the horizontal support may be of any appropriate nature, having any suitable cross sectional configuration, provided it is of a length greater than the length of the coil 6 and sufficient to have its free ends rest upon vertical supports 2 and 3. While not required, it is preferred that the horizontal support 8 be of circular cross section and of such size as to be just nicely received through the eye 7 of the coil 6. In this way, the horizontal support can give maximum support to the coil 6.

Finally, the vertical supports 2 and 3 have at their upper edges notches 9 and 10, respectively. Preferably, the notches 9 and 10 are arcuate and of a diameter substantially the same as the outside diameter of horizontal support 8 so that the horizontal support may be received therein and precluded from transverse movement. It would be within the scope of the present invention to provide V-shaped notches, as is indicated in broken lines at 9*a* in FIG. 2. This would enable the vertical supports 2 and 3 to accommodate in a steady fashion horizontal elements of different diameters. The notches 9 and 10 may have other configurations, depending upon the cross sectional configuration of the horizontal support 8, as will be obvious to one skilled in the art.

Figure 4:
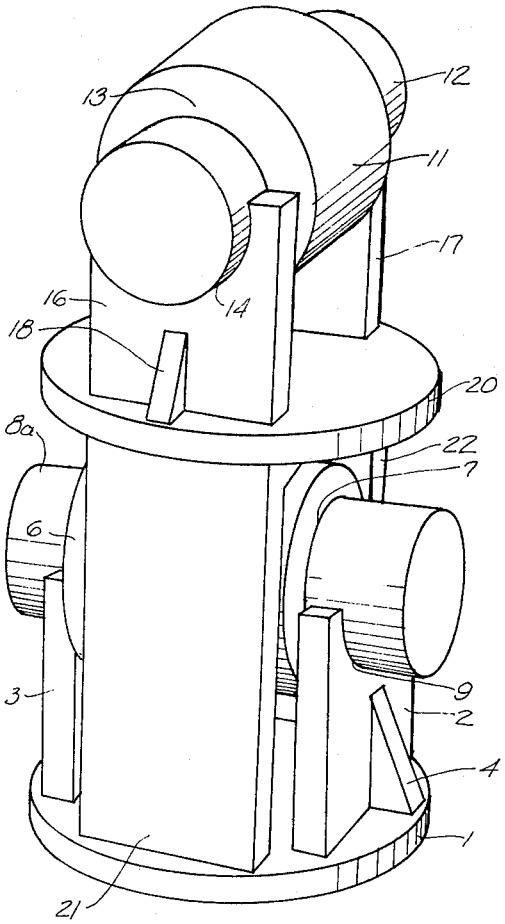
FIG. 4 is a perspective view illustrating support means of the present invention for supporting two coils and showing the coils mounted in place.
Figure 5:
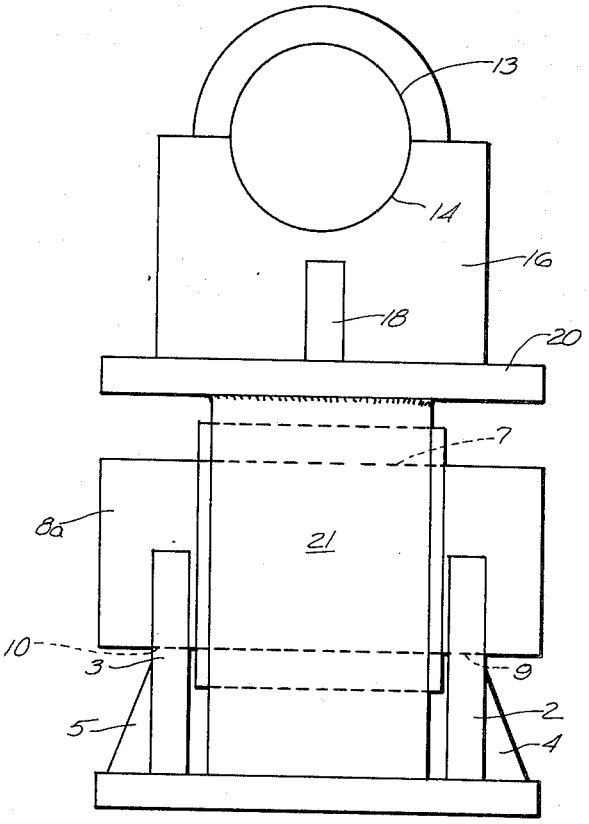
FIG. 5 is an end elevational view of the coils and support means of FIG. 4.
Figure 6:
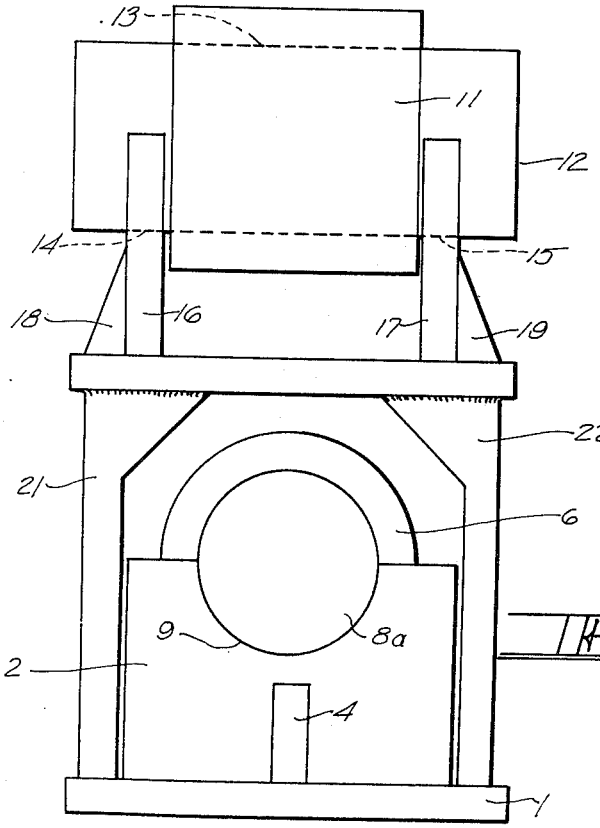
FIG. 6 is a side elevational view of the coil and support means assembly of FIG. 4.

FIGS. 4, 5 and 6 illustrate another embodiment of the support means of the present invention whereby two coils may be held with their axes horizontally oriented.

The bottommost coil and support means therefor is substantially identical to that of FIGS. 1 through 3 and like parts have been given like index numerals. Again, the configuration of the base 1 will depend in part at least upon the type of annealing furnace used. Affixed to the base 1 is a pair of vertical supports 2 and 3 with additional brace means 4 and 5, respectively. The vertical brace means are notched as at 9 and 10 to receive a horizontal support 8*a* extending through the eye 7 of coil 6. The horizontal support 8*a* may be identical to the horizontal support 8 of FIGS. 1 through 3. For purposes of an exemplary showing, however, it is illustrated in the form of a solid or cylindrical shaft-like member.

A second coil 11 is illustrated in a position above the coil 6 and has a horizontal support 12 passing through its eye 13. The horizontal support 12 may be identical to horizontal support 8*a*. The free ends of horizontal support 12 are mounted in notches 14 and 15 in the upper edges of vertical supports 16 and 17. The vertical supports 16 and 17 may be identical to vertical supports 2 and 3 and may be provided with similar brace means 18 and 19 respectively.

Vertical support means 16 and 17 and brace means 18 and 19 are permanently affixed, as by welding or the like, to a second base member 20 which may have any appropriate configuration. The base member 20 is, for purposes of an exemplary showing, illustrated as being a disc-like element identical to base member 1.

The support structure for coil 11 differs from that of coil 6 in only two primary respects. First of all, the support means is oriented so that the horizontal axis of coil 11 is perpendicular to the horizontal axis of coil 6. Secondly, a pair of downwardly depending legs 21 and 22 are permanently affixed (as by welding or the like) to the underside of base 20. The legs 21 and 22 (as is most clearly shown in FIG. 6) are parallel, so spaced with respect to each other and of such height that they can straddle the lower coil 6 with their bottom ends resting upon base member 1.

In the practice of the process of the present invention, the metallic material to be subjected to a high temperature anneal may first be provided with an appropriate annealing separator of any of the types described above. If the metallic material is silicon-iron destined to have a cube-on-face orientation, it may be dusted with alumina. The metallic strip is then coiled on a conventional coiling machine.

After coiling, the coil may be removed from the coiling mandrel and provided with an appropriate horizontal support inserted through its eye. Alternatively, the coiling mandrel of the coiling machine may be used as the horizontal support, as illustrated in FIG. 1. The coil 6 and its horizontal support 8 are then placed upon the vertical supports 2 and 3 of the support assembly in the annealing furnace and the high temperature anneal may be performed. In the processing of cube-on-face oriented silicon-iron, for example, the anneal will be conducted at a temperature of from about 1900°F to 2300°F and preferably at about 2200°F for 24 hours. Actual tests have shown that excellent quality cube-on-face oriented silicon-iron is produced in accordance with the present invention and the coil displays no sagging, buckling or sticking or welding at the convolution edges. In instances wherein it is desirable for the annealing atmosphere to be in intimate contact with the coil convolutions, the process and apparatus of the present invention is advantageous in that the annealing atmosphere may permeate between the coil convolutions from both ends of the coil. Better and more even heating of the coil may also be achieved through the practice of the present invention.

The use of the embodiment of FIGS. 4 through 6 is substantially identical to that described with respect to FIGS. 1 through 3. It will be understood that the coil 6 and its horizontal support 8 will first be placed on vertical supports 2 and 3. Once the coil 6 is in position, the support structure for coil 11 (including vertical supports 16 and 17, brace members 18 and 19, base 20 and legs 21 and 22) is positioned on base 1 in the manner described with respect to FIGS. 4 through 6. Coil 11 and its horizontal support 12 is then placed upon vertical supports 16 and 17. Thereafter, the high temperature anneal may be conducted as outlined above. It will be understood that the coil 6 in the embodiment of FIGS. 1 through 3 is contacted only by horizontal support 8. Similarly, in the embodiment of FIGS. 4 through 6, the coils 6 and 11 are contacted solely by their respective horizontal supports 8*a* and 12.

Modifications may be made in the invention without departing from the spirit of it. The primary consideration is the provision of a horizontal support member passing through the eye of the coil, the horizontal support member being so mounted that it is the only support element in contact with the coil. Therefore, it would be within the spirit of the invention to provide means to hold the horizontal support in position from one of its ends only or to suspend the horizontal support within the annealing furnace.

The embodiments of the invention in which an exclusive property or privilege is claimed are defined as follows:

1. Means for supporting a coil of silicon steel in an annealing furnace with the coil axis horizontally oriented during a high temperature anneal conducted at a temperature of from about 1900°F. to about 2300°F., said coil support means comprising an elongated element insertable within the eye of said coil and means to hold said elongated element in a horizontal position within said furnace, said elongated element and holding means being of such size and configuration that said coil within said furnace is contacted only by said elongated element and only within its eye, said elongated element being of a length greater than the length of said coil whereby the ends of said elongated element when inserted in said eye of said coil are free and extend beyond the end of said coil, said holding means being a unitary structure comprising a horizontal base, a pair of parallel uprights being affixed to said base, said uprights being spaced from each other by a distance greater than the length of said coil and less than the length of said elongated element, said uprights having upper ends configured to support said free ends of said elongated element.

2. The structure claimed in claim 1 wherein said elongated element is a shaft-like element having a circular cross section of a diameter substantially the same as the diameter of said eye of said coil.

3. The structure claimed in claim 1 wherein said elongated element comprises a conventional coiling machine mandrel.

4. The structure claimed in claim 1 including a second substantially identical coil support means for a second coil of metallic strip material, said second support means comprising an elongated element and a base with a pair of parallel uprights thereon, said base of said second support means having a pair of parallel legs depending therefrom, said legs being adapted to rest upon said base of said first mentioned coil support means, said legs being so spaced with respect to each other and of such length that they straddle said elongated element of said first mentioned coil support means and a coil mounted thereon.

* * * * *